US010711748B2

(12) United States Patent
Niwa et al.

(10) Patent No.: US 10,711,748 B2
(45) Date of Patent: Jul. 14, 2020

(54) FUEL SUPPLY DEVICES

(71) Applicant: AISAN KOGYO KABUSHIKI KAISHA, Obu-shi, Aichi-ken (JP)

(72) Inventors: Kensuke Niwa, Nagoya (JP); Koji Yoshida, Kasugai (JP); Tatsuki Fukui, Novi, MI (US); Hiroyasu Kariya, Kariya (JP)

(73) Assignee: Aisan Kogyo Kabushiki Kaisha, Obu-Shi, Aichi-Ken (JP)

( * ) Notice: Subject to any disclaimer, the term of this patent is extended or adjusted under 35 U.S.C. 154(b) by 52 days.

(21) Appl. No.: 15/523,529

(22) PCT Filed: Nov. 2, 2015

(86) PCT No.: PCT/JP2015/080923

§ 371 (c)(1),
(2) Date: May 1, 2017

(87) PCT Pub. No.: WO2016/072388

PCT Pub. Date: May 12, 2016

(65) Prior Publication Data

US 2017/0314521 A1 Nov. 2, 2017

(30) Foreign Application Priority Data

Nov. 7, 2014 (JP) ..... 2014-226900

(51) Int. Cl.
*F02M 37/10* (2006.01)

(52) U.S. Cl.
CPC ..... *F02M 37/106* (2013.01); *F02M 37/10* (2013.01)

(58) Field of Classification Search
CPC ..... F02M 37/106; F02M 37/10
See application file for complete search history.

(56) References Cited

U.S. PATENT DOCUMENTS 4,844,704 A * 7/1989 Jiro ..... B01D 35/0273 417/307
6,123,511 A * 9/2000 Sertier ..... B60K 15/077 123/509
7,210,465 B2 5/2007 Ikeya
(Continued)

FOREIGN PATENT DOCUMENTS

JP S62163132 U 10/1987
JP H01-87031 U 6/1989
(Continued)

OTHER PUBLICATIONS

International Patent Application No. PCT/JP2015/080923 International Search Report dated Jan. 26, 2016 (5 pages).
(Continued)

*Primary Examiner* — Joseph J Dallo
*Assistant Examiner* — Kurt Philip Liethen
(74) *Attorney, Agent, or Firm* — Conley Rose, P.C.

(57) ABSTRACT

A fuel supply device includes a fuel pump for delivering fuel within the fuel tank to the outside and a sub-tank having a temporary storage region capable of temporarily storing the fuel. The sub-tank includes an inflow opening to allow the fuel to flow into the sub-tank under its own weight. The temporary storage region includes a top part positioned above the inflow opening.

18 Claims, 6 Drawing Sheets

(56) References Cited

U.S. PATENT DOCUMENTS

| | | | | |
|---|---|---|---|---|
| 7,303,378 | B2 * | 12/2007 | Kleppner | B60K 15/077 417/87 |
| 2010/0228299 | A1 * | 9/2010 | Zrinski | A61B 17/8014 606/286 |
| 2015/0167597 | A1 * | 6/2015 | Nagasaku | F02M 25/0854 123/520 |
| 2017/0254303 | A1 * | 9/2017 | Takahashi | F02M 37/00 |

FOREIGN PATENT DOCUMENTS

| | | | | |
|---|---|---|---|---|
| JP | H03-15817 | Y2 | | 4/1991 |
| JP | 2006-29317 | A | | 2/2006 |
| JP | 2012-036854 | A | | 2/2012 |
| JP | 2012-067736 | A | | 4/2012 |
| JP | 2012184760 | A | * | 9/2012 |
| JP | 2013-227929 | A | | 11/2013 |

OTHER PUBLICATIONS

Japanese Office Action dated Nov. 7, 2017, for Japanese Application No. 2014-226900 (4 p.).
English Translation of Japanese Office Action dated Nov. 7, 2017, for Japanese Application No. 2014-226900 (3 p.).

* cited by examiner

FUEL SUPPLY DEVICES

CROSS-REFERENCE TO RELATED APPLICATIONS

The present application is a National Phase entry of, and claims priority to, PCT Application No. PCT/JP2015/080923, filed Nov. 2, 2015, which claims priority to Japanese Patent Application No. 2014-226900, filed Nov. 7, 2014, both of which are incorporated by reference herein in their entireties for all purposes.

STATEMENT REGARDING FEDERALLY SPONSORED RESEARCH OR DEVELOPMENT

Not applicable.

BACKGROUND

The present disclosure relates to a fuel supply device. More particularly, it relates to a fuel supply device for supplying fuel from within a fuel tank to an internal combustion engine, wherein the fuel tank is mounted to a vehicle, for example an automobile.

A fuel supply device used for supplying fuel from within a fuel tank to an internal combustion engine is widely known in the art. Japanese Laid-Open Patent Publication No. 2012-67736 discloses such a fuel supply device, with a configuration capable of temporarily storing fuel in one part of the device. In particular, this configuration enables fuel to naturally flow into a sub-tank through an inflow opening formed in the uppermost part of the sub-tank, wherein the fuel can be temporarily stored in the sub-tank. However, this configuration can still be further improved.

BRIEF SUMMARY

The configuration described above enables the fuel to naturally flow into the sub-tank through the inflow opening formed in the uppermost part of the sub-tank. Consequently, a relatively large volume of fuel can be discharged from the inflow opening as an outflow when the fuel slants to one lateral side of the sub-tank due to the vehicle turning, etc. Therefore, there is a need for a technique that may prevent outflow of fuel within the sub-tank from the inflow opening.

According to one aspect of the present disclosure, a fuel supply device includes a fuel pump for delivering fuel within a fuel tank and a sub-tank having a temporary storage region capable of temporarily storing the fuel. The sub-tank includes an inflow opening to allow the fuel to flow into the sub-tank under its own weight. The temporary storage region has a top part positioned above the inflow opening. As a result, the fuel may shift within the temporary storage region itself when a vehicle turns, for example, or at the time of abrupt braking, etc., due to the region having the top part which is positioned higher than the inflow opening. Consequently, the fuel within the sub-tank may be prevented from flowing out as an outflow through the inflow opening.

According to another aspect of the disclosure, in addition to the inflow opening, the sub-tank may also include an air vent hole that allows communication between the temporary storage region and the outside of the sub-tank, allowing air to flow through. Therefore, the fuel can flow smoothly from the inflow opening to the temporary storage region.

According to another aspect of the disclosure, the air vent hole may be positioned above the inflow opening. Therefore, the fuel can flow smoothly to a position higher than the inflow opening within the temporary storage region.

According to another aspect of the disclosure, the air vent hole may be formed at the top part of the temporary storage region. Therefore, the fuel can flow smoothly at the highest position within the temporary storage region.

According to another aspect of the disclosure, the top part of the temporary storage region may be positioned along a lateral edge. When the vehicle turns etc., the fuel may be shifted to the lateral edge side of the temporary storage region. In the lateral edge position, a space for storing the fuel is present. Therefore, the outflow of the fuel from the inflow opening may be effectively prevented because of the temporary storage region.

DETAILED DESCRIPTION

Figure 1:
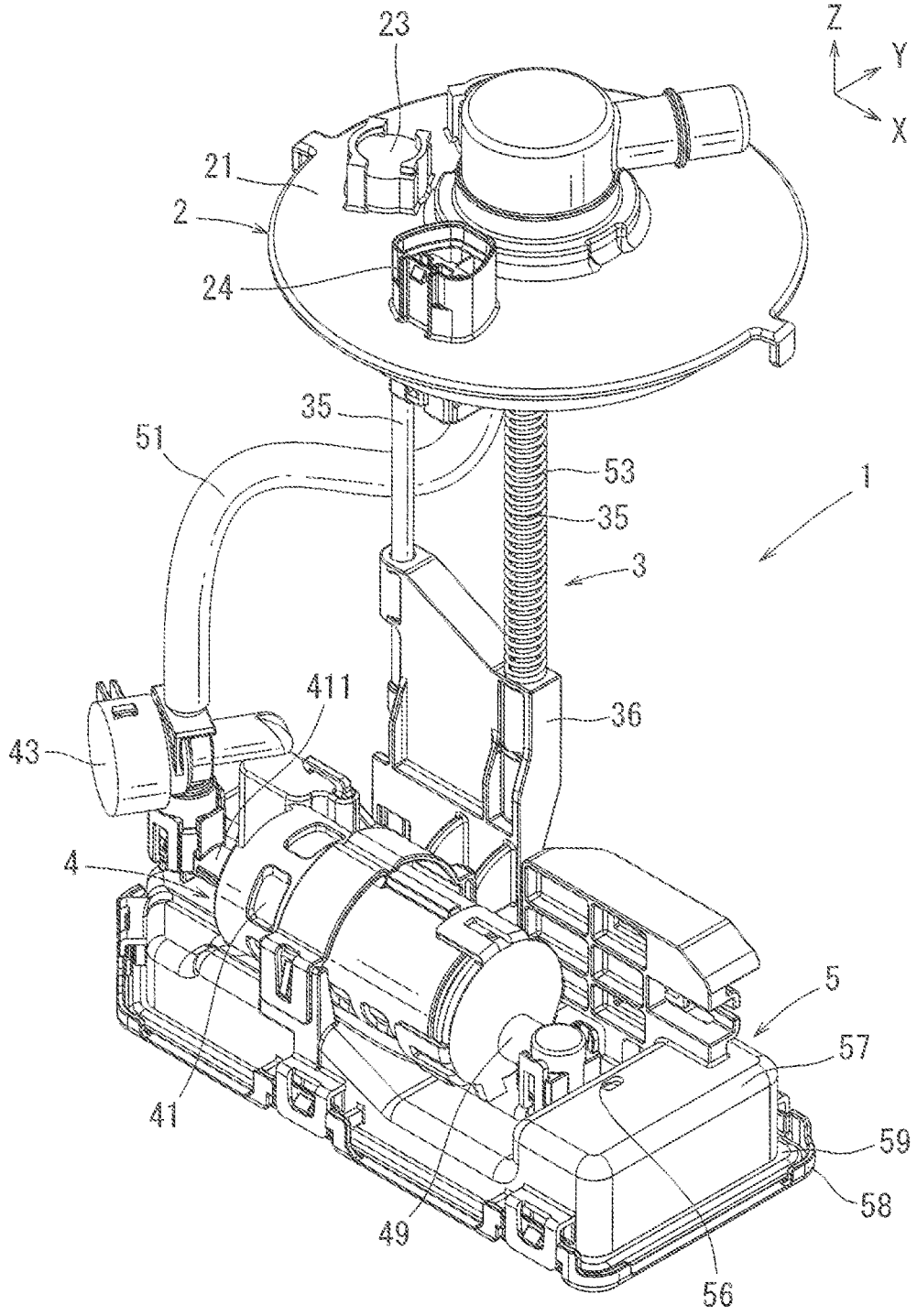
FIG. 1 is a perspective view of a fuel supply device.

One embodiment of the present disclosure will now be described with reference to the drawings. The forward and backward directions, upward and downward directions as well as leftward and rightward directions in the present specification are determined such that X is a forward direction, Y is a leftward direction and Z is an upward direction as shown in FIG. 1, where the backwards, rightwards, and downwards directions extend in the negative opposing direction of X, Y, and Z, respectively. A cover member 2 of a fuel supply device 1 is usually positioned at an upper direction and a pump unit 4 is positioned at a lower direction. In the description that follows, the directions are referred to with the assumption that the fuel supply device 1 is attached to the fuel tank 7, as shown in FIG. 2, unless otherwise specifically noted.

A fuel supply device 1 may be mounted on a vehicle, and particularly, for example, on an automobile. The fuel supply device 1 is attached to the fuel tank 7 arranged below the floor of the vehicle. The fuel supply device 1 is used to feed liquid fuel F stored within the fuel tank 7 into an internal combustion engine (not shown).

Figure 2:
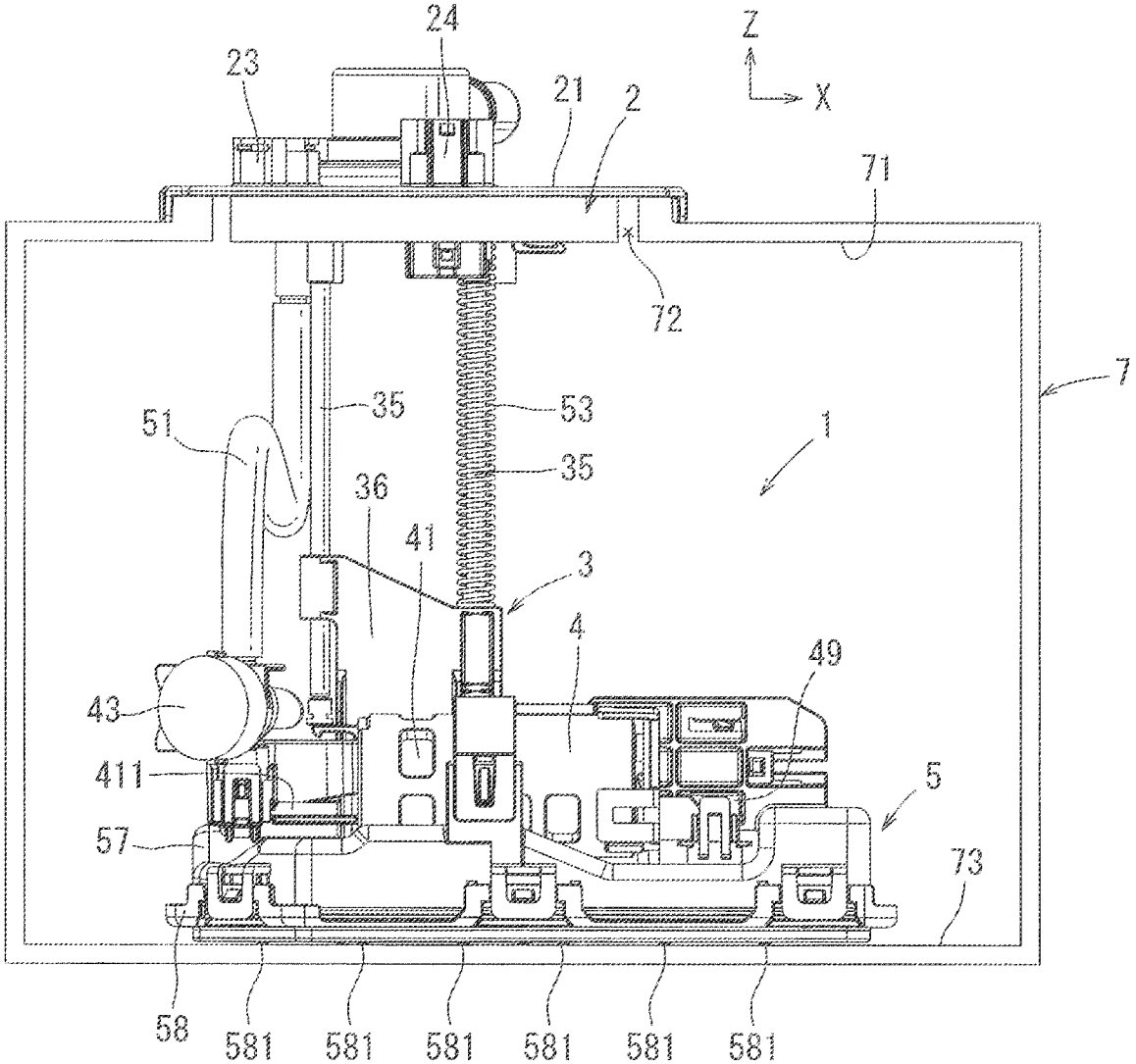
FIG. 2 is a side view showing the fuel supply device attached to a fuel tank.

As shown in FIGS. 1 and 2, the fuel supply device 1 comprises a cover member 2 attached to an opening 72 formed in an upper portion 71 of the fuel tank 7, and a pump unit 4 with a pump 41 for delivering fuel F within the fuel tank 7 to the outside. Further, the fuel supply device 1 comprises a sub-tank 5 having a temporary storage region S showing in FIG. 4 capable of temporarily storing the fuel F by allowing the fuel F naturally to flow into the storage region S, and the device 1 also comprises a connecting member 3 which connects the cover member 2 with the sub-tank 5. The sub-tank 5 is installed at the bottom surface 73 of the fuel tank 7. More specifically, the opening 72 of the fuel tank 7 may be closed when the cover member 2 is attached to and covers the opening 72 of the fuel tank 7 while the sub-tank 5 abuts the bottom surface 73 of the fuel tank 7.

As shown in FIGS. 1 and 2, the cover member 2 includes a set plate 21 which covers the opening 72 of the fuel tank 7. The substantially disk-shaped set plate 21 comprises an outlet port 23 for leading fuel F delivered from the pump unit 4 to the outside of the fuel tank 7. Further, the set plate 21 comprises an electric connector 24 for connecting electric wiring. The opening 72 of the fuel tank 7 normally has a circular shape, and the set plate 21 also has a substantially circular shape in plan view, which is concentric with and thus corresponds to the shape of the opening 72. A ring made of resin (not shown) e.g. an O-ring is attached to the opening 72 as a sealing member to prevent a gap from being formed between the fuel tank 7 and the cover member 2.

As shown in FIGS. 1 and 2, the connecting member 3 is telescopic, and is configured such that it can be extended and retracted. The connecting member 3 includes a rod member 35 attached to the cover member 2 and a joint portion 36 which is movable along the rod member 35. The rod member 35 extends in a direction orthogonal to the plane in which the set plate 21 extends radially. A spring member 53 that can exert elastic force is arranged between the joint portion 36 and the cover member 2. The spring member 53 biases the sub-tank 5 to move away from the cover member 2 whenever the cover member 2 and the sub-tank 5 mutually approach closer than a predetermined distance. In this manner, the spring member 53 is compressed while the cover member 2 is moved towards the bottom surface 73 of the fuel tank 7 from the state in which the bottom surface of the sub-tank 5 abuts and contacts the bottom surface 73 of the sub-tank 5. As long as the compressed state of the spring member 53 is maintained, the pressed state of the sub-tank 5 against the bottom surface 73 of the fuel tank 7 is also maintained.

As shown in FIGS. 1 and 2, the fuel supply device 1 includes a pump unit 4 arranged below the cover member 2. The pump unit 4 includes a fuel pump 41 for delivering the fuel F. The pump unit 4 is supported by the sub-tank 5. The sub-tank 5 is formed as a substantially flat plate shaped sub-tank, and arranged such that one lateral side of the sub-tank 5 oppositely faces and abuts the bottom surface 73 of the fuel tank 7. The sub-tank 5 may also be referred to as a fuel reservoir, etc. The sub-tank 5 includes an upper member 57 to which the pump unit 4 is attached, a lower member 58 which abuts the bottom surface 73 of the fuel tank 7, and a filter member 59 interleaved between the upper member 57 and the lower member 58. A suction port 49, which can suck the fuel F filtered by the filter member 59, is formed in the pump unit 4. Therefore, it is configured such that the fuel passed through the filter member 59 can be sucked by the fuel pump 41. In addition, the filter member 59 is obtained by superimposing substantially rectangular non-woven fabrics on each other, and connecting them to each other along their respective peripheries, and as shown in FIG. 4, a frame 81 is disposed between the non-woven fabrics to form a space inside.

An opening (not shown) covered with a lattice is formed at a bottom surface of the lower base 58. As shown in FIGS. 2 and 4, legs 581 are provided protruding from the bottom of the lower member 58, which provide clearance between the lower base 58 and the bottom surface 73 of the tank 7 thus forming an opening, such that the fuel F can be sucked from the opening even when the lower member 58 is arranged to contact with the bottom surface 73 of the fuel tank 7. Further, the outer perimeter of the upper base 57 is configured to be slightly smaller than the outer perimeter of the lower member 58. Thus, a radial gap is formed between the upper member 57 and the lower member 58 along their respective outside perimeters when the filter member 59 is not interleaved in between. The gap can serve to introduce fuel F into the sub-tank 5. Since the filter member 59 is arranged to cover the outer periphery of the bottom of the lateral sides of the upper member 57, as shown in FIG. 1, the fuel entering into the sub-tank 5 from the gap may arrive at the fuel pump 41 after passing through the filter member 59.

As shown in FIGS. 1 and 2, a pressure adjusting valve 43 for adjusting the feed pressure of the fuel is mounted to the pump unit 4. The pressure adjusting valve 43 is mounted to a valve supporting portion 411 extending from the fuel pump 41. The fuel F, with adjusted pressure by the pressure adjusting valve 43, is delivered to the internal combustion engine through a hose 51 and/or a discharge port 23, etc.

Figure 3:
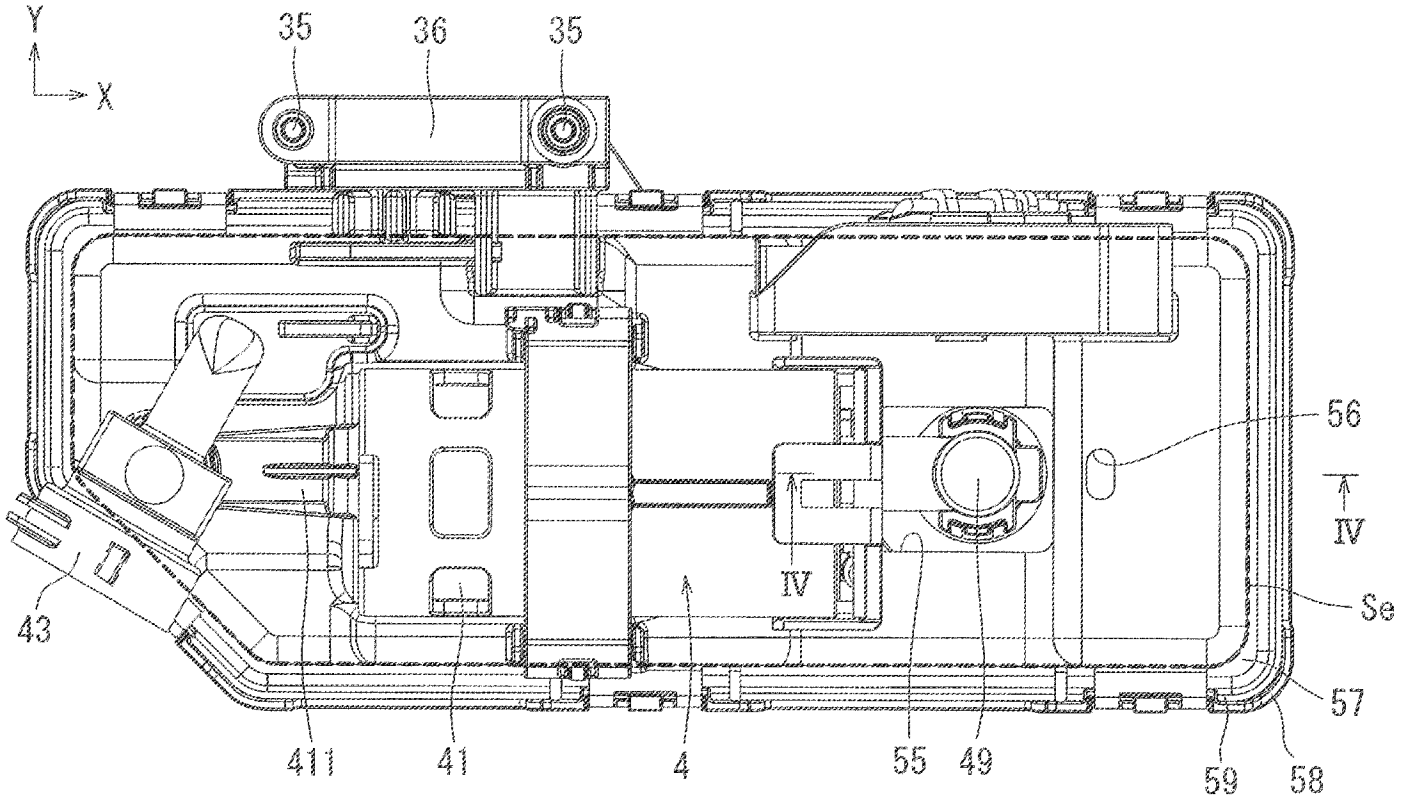
FIG. 3 is a plan view of the fuel supply device around a sub-tank.
Figure 4:
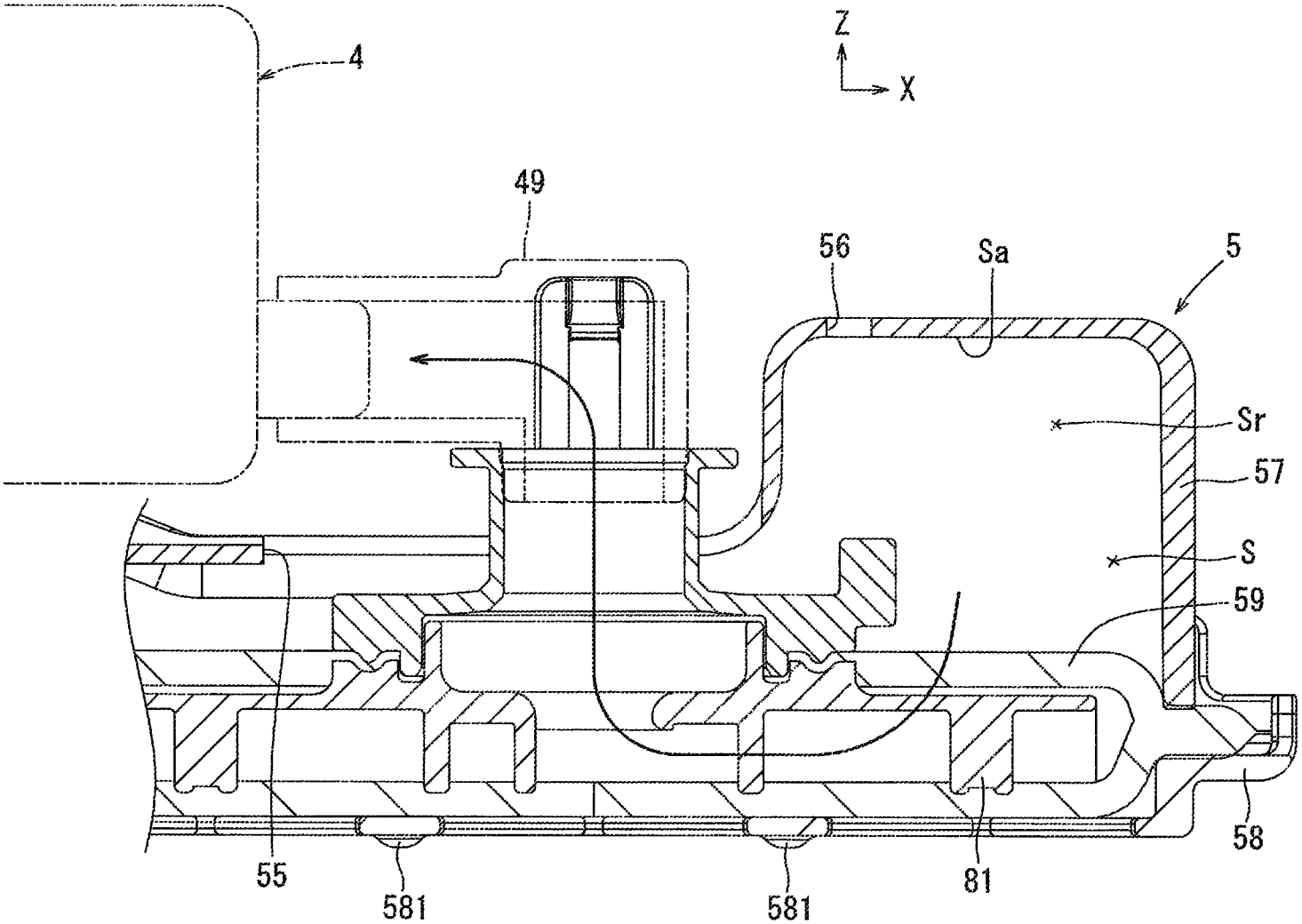
FIG. 4 is a cross-sectional view taken along line IV-IV in FIG. 3.

As shown in FIGS. 3 and 4, an inflow opening 55 is formed in the sub-tank 5 of the pump unit 4. The inflow opening 55 enables the fuel F to naturally flow into the sub-tank 5 if more than a predetermined amount of fuel F is present within the fuel tank 7 but outside of the sub-tank 5. The inflow opening 55 is open to the fuel tank 7 such that the fuel F can enter into the sub-tank 5 under its own weight without using an electric feed means.

As shown in FIG. 4, the sub-tank 5 includes a temporary storage region S for retaining fuel F that enters the temporary storage region S by gravity, through the inflow opening 55. The temporary storage region S is a region mainly defined by an upper surface of the filter member 59 as the bottom periphery of S and an inner surface of the upper member 57, which form the lateral and top peripheries of S. In addition, as indicated by an arrow in FIG. 4, the pump unit 4 can suck the fuel F that enters the interior space of filter member 59 from the upper surface of the filter member 59, including fuel from the region of the upper surface forming the bottom periphery of storage region S. Therefore, the fuel F may leak from the temporary storage region S to the interior space of filter member 59. In particular, because the pump unit 4 can suck a part of the fuel F, which is reserved within the temporary storage region S, when said fuel leaks out of the temporary storage region S into the interior space of filter member 59, and because the pump unit 4 can feed said fuel from the interior space of filter member 59 to the internal combustion engine, it is possible to prevent the occurrence where the internal space of the filter member 59 fills up to the extent that the fuel F cannot be fed to the internal combustion engine. To aid in this endeavor, the filter member 59 is configured such that the fuel F is moderately hard to pass through.

Figure 5:
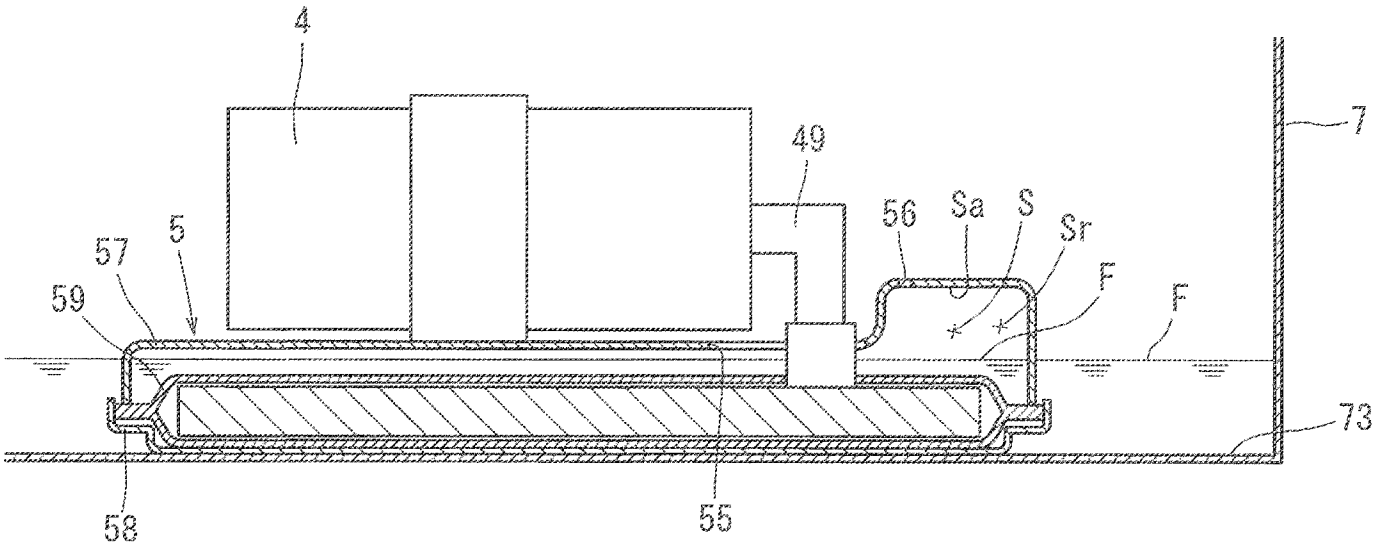
FIG. 5 is a view illustrating an example of the relationship between the fuel and the fuel supply device that is inserted in the fuel tank.
Figure 6:
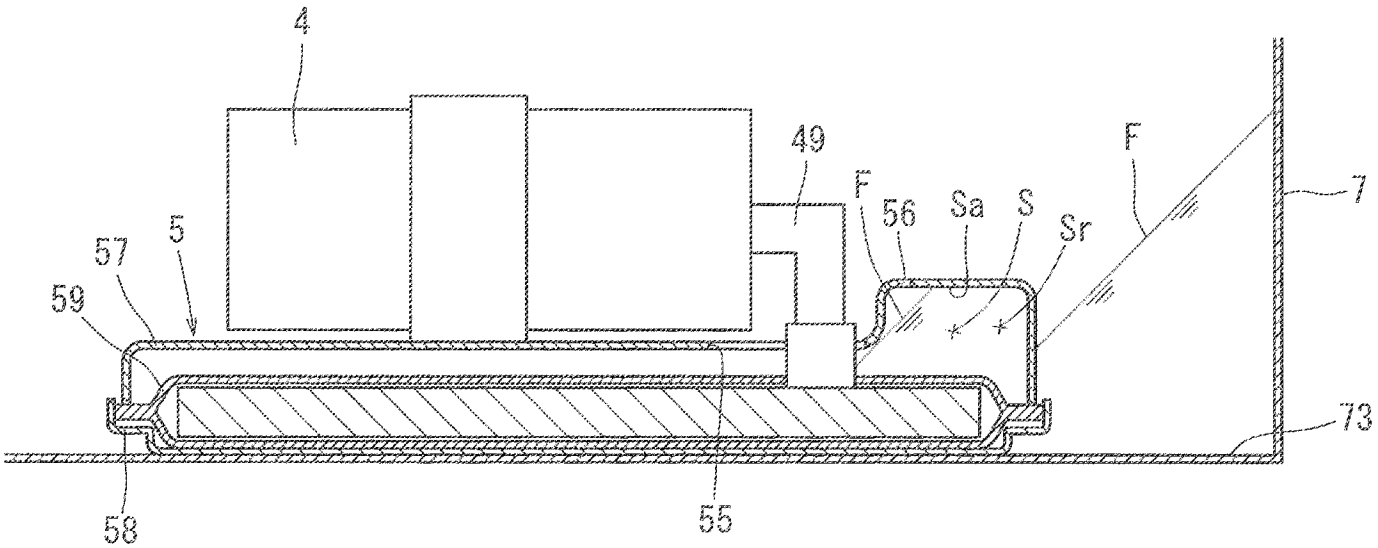
FIG. 6 is a view illustrating an example of the behavior of the fuel when the turning force is applied to the fuel tank, in which the fuel supply device shown in FIG. 5 is inserted.

As shown in FIG. 4, a top part Sa of the temporary storage region S is positioned above the inflow opening 55. More specifically, the temporary storage region S includes a space Sr having a substantially rectangular parallelepiped shape at a position higher than the inflow opening 55. The space Sr is not provided for the purpose of increasing an amount of fuel stored within the temporary storage region S when a vehicle is stopped. For example, when a vehicle is stopped, if the fuel F within the fuel tank 7 is only present up to the position lower than the inflow opening 55, it is expected that the fuel F will be positioned below the substantially rectangular parallelepiped space Sr as shown in FIG. 5. However, when the vehicle mounted with the fuel tank 7 turns, the motion of the vehicle may cause force may be applied to the fuel F within the fuel tank 7 from the side. In this case, the fuel F may shift, for example, from the state shown in FIG. 5 to the state shown in FIG. 6, where the fluid rises in an asymmetric manner. Here, the fuel F, that would have been discharged from the inflow opening 55 to the outside of the temporary storage region S, if there were no space Sr, may instead be retained in the temporary storage region S because the top part Sa of the fuel storage region is positioned above the inflow opening 55, and thus due to its extended height relative to inflow opening 55 with space Sr, is able to capture fuel F when it rises in an asymmetric manner due to the vehicle being in motion, as shown in FIG. 6.

As shown in FIG. 4, an air vent hole 56 through which the air can enter or exit is formed in the sub-tank 5. The air vent hole 56 is formed at a different position from the position of the inflow opening 55, and is formed such that a part of the temporary storage region S positioned above the inflow opening 55, including space Sr, can communicate with the outside of the sub-tank 5. More specifically, a lower end of the air vent hole 56 is positioned above an upper end of the inflow opening 55. Providing the air vent hole 56 in this positional configuration facilitates smooth flow of the fuel F from the inflow opening 55 in the temporary storage region S due to pressure equilibration via venting. Further, the air vent hole 56 is provided to communicate the top part Sa positioned at the uppermost part of the temporary storage region S with the outside of the sub-tank 5. In particular, the region within the temporary storage region S positioned above the inflow opening 55, including space Sr, may be effectively used by providing the air vent hole 56 at this part.

As shown in FIGS. 3 and 4, the air vent hole 56 is positioned above the inflow opening 55 in the temporary storage region S. The air vent hole 56 is disposed at the portion of the top part Sa of the temporary storage region S that is at the backwards end of Sa close to a central position of the sub-tank 5 in the leftwards-rightwards direction, as shown in plan view in the XY plane (see FIG. 3), where said hole allows communication between the top portion of the tank and respective portion of space Sr proximal to the hole, with the outside of the sub-tank 5. A dot-dashed-line Se in FIG. 3 indicates an outline of the outer edge Se of the temporary storage region S in the plan view. The portion of the temporary storage region S proximal to the central position is positioned relatively far from the outer edge Se of the temporary storage region S as seen in the plan view, and thus the distance between said outer edge Se and the air vent hole 56 is relatively long. Therefore, as shown in FIG. 6, when the vehicle turns such that the fuel F rises asymmetrically, due to the presence of the air vent hole 56 on the backwards edge of the top part Sa of the temporary storage region S, far from the outer edge, the fuel F due to the sideways centrifugally outward force, rises towards the outer edge, and is effectively prevented from discharging from the air vent hole 56 to the outside of the sub-tank 5.

As shown in FIGS. 3 and 4, the top part Sa is positioned along the forward region of the outer edge Se of the temporary storage region S. The air vent hole 56 has a substantially smoothed rectangular opening as seen from a plan view in FIG. 3, wherein its location extends the distance to the outer edge Se of the temporary storage region S as seen from a plan view. That is, the air vent hole 56 is formed along the backward edge of the top part Sa wherein the edge is positioned opposite to the forward region of the outer edge Se of the temporary storage region S. The air vent hole 56 is an elongated hole with a longitudinal direction extending along the backwards edge of the top part Sa, parallel to the leftwards-rightwards directional axis. The air vent hole 56 is formed on the upper surface of the substantially rectangular parallelepiped space Sr. Further, the air vent hole 56 is positioned centrally in the vicinity of space Sr in the leftwards-rightwards direction, and is also placed in the region closer to the center of the temporary storage region S in the forward-backward direction as seen from the XY plan view in FIG. 3.

As shown in FIG. 3, the air vent hole 56 is configured such that the width of the hole extending in a forwards-backwards direction toward its center, as seen from the XY plan view in FIG. 3, will be shorter than the length of the hole in the leftwards-rightwards direction orthogonal to the previously noted direction. More specifically, the longitudinal direction of the air vent hole 56 is orthogonal to the forwards-backwards direction oriented from a substantial center of the temporary storage region S in a plan view toward the substantial center of the air vent hole 56 in a plan view. As a result, because of the elongation of the hole in the leftwards-rightwards direction, orthogonal to the force applied to the fuel in the temporary storage region S when the vehicle is in motion, the fuel F may thus be prevented from discharging out of the sub-tank 5 through the air vent hole 56, while at the same time an opening area necessary for proper equilibration is ensured for the air vent hole 56.

As shown in FIG. 3, the outline of the outer edge of the temporary storage region S in a plan view is indicated by the dot-dashed-line Se. As may be understood from this, the inflow opening 55 is positioned in a location different from the center of the temporary storage region S in a plan view. Therefore, the region behind or backwards relative to the inflow opening 55, is longer than the region in the front of said opening, and additionally the area of the backwards region is also wider than that of the front region. The backward region may be used as one part of the temporary storage region S such that a large volume is ensured. On the other hand, the height of the front region is higher than that of the backward region while the backwards-forwards length of the front region is shorter than that of the backward region. The necessary volume is thus provided for both the backward and front regions of the temporary storage region S.

As shown by the asymmetric liquid level in FIG. 6, if the height of the temporary storage region S, in contrast to the embodiment shown in FIG. 6, was uniform, then the fuel F would easily be discharged from inflow opening 55 when centrifugally outward force is exerted to shift the fuel F to the side since the turning force is exerted, while as shown in FIG. 5, there is no substantial change in discharging the fuel no matter where the inflow opening 55 is positioned in a plan view when the vehicle is stopped. The fuel may be prevented from discharging to a certain degree if the space of the temporary storage region S, with uniform height as described above, could be formed to have the inflow opening 55 arranged at the center. However, in this configuration, the position of the inflow opening 55 would be limited to the center. As a result, an installation area for the fuel supply device 1 may need to be increased. However, this positional limitation for the inflow opening 55 can be reduced if a part of the temporary storage region S, such as the top part Sa of the current embodiment, is present such that it ensures the height of a part of the temporary storage region S up to the position higher than the inflow opening 55. As a result, in this manner, as present in the embodiment shown in FIG. 6, excessive discharge from the inflow opening 55 can be prevented, and the installation area for the sub-tank 5 is also reduced.

As noted above, according to the fuel supply device 1, the fuel F less likely flows out of the inflow opening 55 than the scenario with uniform height with inflow opening 55, as described above, since the fuel F shifts within the temporary storage region S, where the higher region of top part Sa ensures the height of a part of the temporary storage region S up to a position higher than the inflow opening 55. The inflow opening 55 into which the fuel F may naturally flow, can be positioned at a relatively low position. Accordingly, with a lower position, the fuel F may also be more easily introduced in the temporary storage region S even if the residual amount of the fuel F within the fuel tank 7 is small.

As noted above, the fuel supply device 1 is configured such that it can reduce the possibility of fuel F flowing out of the temporary storage region S through the inflow opening 55. In this configuration, when only a small amount of the fuel F remains in the fuel tank 7, once the fuel F is discharged outside of the temporary storage region S within fuel tank 7, even if the turning force is released from a state in which the turning force is applied (e.g. there is a state transition from FIG. 6 to FIG. 5), it is difficult for the small amount of fuel F to be re-introduced back into the temporary storage region S. To prevent this from happening, the fuel supply device 1 can reserve a small amount of additional fuel F within the temporary storage region S, with the configuration as described above, including top part Sa and space Sr. Therefore, the situation in which the fuel F cannot be delivered to an internal combustion engine may efficiently be prevented.

The specific embodiments of the present disclosure have been described with reference to the above configurations, however, it is obvious for a person skilled in the art that various replacements, modifications and changes are possible without departing from the object of the present disclosure. Therefore, the embodiments of the present disclosure may include all replacements, modifications and changes, which do not depart from the gist and the object of the attached claims. For example, the embodiments of the present disclosure are not limited to the specific configuration but may be changed as will be described below.

For example, as shown in FIG. 1, the sub-tank 5 includes the filter member 59, and the fuel pump sucks the fuel from the bottom surface of the sub-tank 5. Alternatively, the sub-tank may be configured such that the sub-tank does not allow the fuel to flow out from the bottom surface but rather allows the fuel to flow out of the sub-tank from a lateral surface and/or an upper surface.

The sub-tank 5 described above includes a bottom formed by the filter member 59 and lower member 58, where filter member 59 adheres to the bottom of upper member 57, which has no bottom surface of its own. Alternatively, the sub-tank 5 may be a box with a hole or holes bored in the bottom surface etc. that allows the fuel to flow out.

The inflow opening 55 described above is formed by a hole extending through the upper surface of the sub-tank 5. Alternatively, the inflow opening may be formed by a hole or holes extending through the lateral surface of the sub-tank 5 in the leftward and rightward directions.

The sub-tank 5 described above includes the filter member 59 interposed between the upper member 57 and the lower member 58. Alternatively, the sub-tank 5 may not include either the lower member 58 or the filter member 59, or both. However, the sub-tank 5 with this configuration also needs a temporary storage region for the fuel.

A canister loaded with an adsorbent material may be provided at the cover member 2. In this case, the connecting member may be configured to connect the canister and the sub-tank. Alternatively, the connecting member may be configured to connect the set plate and the sub-tank.

The filter member 59 is not essential for the sub-tank 5. Therefore, the sub-tank 5 may be configured without the filter member 59. In this case, the filter member may also be arranged at another part than the sub-tank 5. As far as the fuel to be sucked by the pump is kept clean, the fuel supply device may be configured without a filter member.

The fuel supply device, as applied to vehicles, is not limited to an automobile, but it also may be applied to such a vehicle that flies in the air, e.g. an airplane or a helicopter, or that moves over the sea or in the sea, e.g. a ship or a submarine.

The invention claimed is:

1. A fuel supply device comprising:

a fuel pump for delivering fuel from within a fuel tank, and a sub-tank disposed within the fuel tank and having a temporary storage region capable of temporarily storing fuel, wherein the fuel pump is configured to draw fuel from the sub-tank and deliver fuel outside of the fuel tank;

wherein the sub-tank includes a top cover of the temporary storage region, where the top cover of the temporary storage region forms an uppermost part of an upper surface of the sub-tank, and wherein the sub-tank also includes an inflow opening to allow the fuel to be gravity-fed into the sub-tank under its own weight wherein the inflow opening is formed on the upper surface of the sub-tank;

wherein the inflow opening is directly fluidly coupled to an interior of the sub-tank and to an interior of the fuel tank; and wherein a height of the temporary storage region at the top cover is greater than a height of the temporary storage region at the inflow opening.

2. The fuel supply device of claim 1, wherein the sub-tank includes an air vent hole in addition to the inflow opening, wherein the air vent hole allows communication between an interior of the temporary storage region and the interior of the fuel tank.

3. The fuel supply device of claim 1, wherein the fuel pump is disposed outside of the sub-tank and includes a suction port configured to suck the fuel, and wherein the suction port is connected to a pipe that extends through the inflow opening to communicate the interior of the sub-tank and the fuel pump.

4. The fuel supply device of claim 1, wherein the sub-tank includes a first outer peripheral side and a second outer peripheral side that opposes the first outer peripheral side, wherein the inflow opening is disposed along the top cover of the sub-tank at a location that is closer to the first outer peripheral side than the second outer peripheral side.

5. The fuel supply device of claim 4, wherein the upper surface of the temporary storage region is located between the first outer peripheral side of the sub-tank and the inflow opening.

6. The fuel supply device of claim 1, wherein the upper surface of the sub-tank is positioned below an upper surface of the fuel tank, and wherein the fuel pump is disposed above the upper surface of the sub-tank.

7. The fuel supply device of claim 1, wherein the sub-tank includes a first end and a second end opposite the first end in a plan view, wherein the inflow opening is positioned in a location closer to the first end than the second end, and wherein the top cover of the temporary storage region is positioned in a location between the first end and the inflow opening.

8. The fuel supply device of claim 1, wherein the sub-tank includes an opening that is opened in a downward direction and a filter member configured to cover the opening, wherein the filter member is configured to resist a flow of fuel from the sub-tank, through the filter member, and into the fuel tank such that fuel is to be temporarily stored in the sub-tank when a liquid level in the fuel tank is below a liquid level in the sub-tank.

9. A fuel supply device comprising:

a fuel pump for delivering fuel from within a fuel tank, and a sub-tank disposed within the fuel tank and having a temporary storage region with an outer periphery forming a general shape of an irregular pentagon with an overall length and width in the forwards-backwards and leftwards-rightwards directions, respectively, capable of temporarily storing fuel within its interior, wherein the fuel pump is configured to draw fuel from the sub-tank and deliver fuel outside of the fuel tank;

wherein the sub-tank includes a top cover of the temporary storage region formed in a rectangular prismatic shape with a longitudinal direction in the leftwards-rightwards direction, coincident with the width of the outer periphery of the sub-tank, wherein three sides of the rectangular prismatic shape of the top cover are the uppermost part of the upper surface of the sub-tank as seen in a XZ plane, and wherein the sub-tank also includes an inflow opening to allow the fuel to be gravity-fed into the sub-tank under its own weight wherein the inflow opening is formed on an upper surface of the sub-tank;

wherein the inflow opening is directly fluidly coupled to an interior of the sub-tank and to an interior of the fuel tank; and wherein a height of the temporary storage region at the top cover is greater than a height of the temporary storage region at the inflow opening.

10. The fuel supply device of claim 9, wherein the inflow opening is adjacent to the top cover of the of the temporary storage region in the backwards direction, wherein the fuel pump is disposed outside of the sub-tank and includes a suction port configured to suck the fuel, and wherein the suction port is connected to a pipe that extends through the inflow opening to communicate the interior of the sub-tank and the fuel pump.

11. The fuel supply device of claim 9, wherein the top cover of the temporary storage region also forms part of outer periphery of the temporary storage region in the forward-most direction, bordering a forwardmost edge in the leftwards-rightwards direction, as seen from a plan view in a XY plane.

12. The fuel supply device of claim 9, wherein the sub-tank includes an air vent hole in addition to the inflow opening, wherein the air vent hole is formed on the top cover of the temporary storage region and allows communication between an interior of the temporary storage region and the interior of the fuel tank.

13. The fuel supply device of claim 12, wherein the air vent hole is formed at the top cover of the temporary storage region, at a backwards-most edge of the top cover in the center of the leftwards-rightwards direction, such that when fuel rises in the sub-tank during vehicle operation towards outermost edges, due to centrifugally outward force being applied, then the fuel is effectively prevented from discharging through the air-vent hole to the outside of the sub-tank.

14. The fuel supply device of claim 13, wherein the air vent has a substantially rectangular opening formed as part of the uppermost surface of the top cover of the sub-tank, as seen from a plan view in a XY plane, wherein a longitudinal direction of the rectangular opening is formed along an upper backwards edge of the top cover of the sub-tank, parallel to the leftwards-rightwards directional axis.

15. The fuel supply device of claim 9, wherein the sub-tank includes a first outer peripheral side and a second outer peripheral side that opposes the first outer peripheral side, wherein the inflow opening is disposed along the top cover of the sub-tank at a location that is closer to the first outer peripheral side than the second outer peripheral side.

16. The fuel supply device of claim 9, wherein the upper surface of the sub-tank is positioned below an upper surface of the fuel tank, and wherein the fuel pump is disposed above the upper surface of the sub-tank.

17. The fuel supply device of claim 9, wherein the sub-tank includes a first end and a second end opposite the first end in a plan view, wherein the inflow opening is positioned in a location closer to the first end than the second end, and wherein the top cover of the temporary storage region is positioned in a location between the first end and the inflow opening.

18. The fuel supply device of claim 9, wherein the sub-tank includes an opening that is opened in a downward direction and a filter member configured to cover the opening, wherein the filter member is configured to resist a flow of fuel from the sub-tank, through the filter member, and into the fuel tank such that fuel is to be temporarily stored in the sub-tank when a liquid level in the fuel tank is below a liquid level in the sub-tank.

* * * * *